United States Patent [19]

Goldbeck et al.

[11] 4,343,251

[45] Aug. 10, 1982

[54] SEWING MACHINE

[75] Inventors: Heinz Goldbeck; Helmut Frodermann, both of Bielefeld, Fed. Rep. of Germany

[73] Assignee: Dürkoppwerke GmbH, Bielefeld, Fed. Rep. of Germany

[21] Appl. No.: 48,807

[22] Filed: Jun. 15, 1979

[30] Foreign Application Priority Data

Jun. 16, 1978 [DE] Fed. Rep. of Germany ..... 2826426

[51] Int. Cl.[3] ..... D05B 55/14; D05B 55/10; D05B 69/08

[52] U.S. Cl. ..... 112/221; 112/158 E

[58] Field of Search ..... 112/69, 73, 109, 158 E, 112/163, 221, 276

[56] References Cited

U.S. PATENT DOCUMENTS

| | | | |
|---|---|---|---|
| 2,803,207 | 8/1957 | Sotzky | 112/158 E |
| 3,108,554 | 10/1963 | Payne et al. | 112/221 X |
| 3,160,125 | 12/1964 | Bryant et al. | 112/221 X |
| 3,298,339 | 1/1967 | Johnson | 112/73 |
| 3,760,748 | 9/1973 | Rockerath | 112/276 |
| 3,881,433 | 5/1975 | Davidson | 112/158 E |
| 4,241,677 | 12/1980 | Beisler | 112/221 X |

FOREIGN PATENT DOCUMENTS

| | | | |
|---|---|---|---|
| 124258 | 9/1967 | Czechoslovakia | 112/221 |
| 126719 | 1/1902 | Fed. Rep. of Germany | 112/73 |
| 249924 | 10/1970 | U.S.S.R. | 112/221 |

*Primary Examiner*—Wm. Carter Reynolds
*Attorney, Agent, or Firm*—Karl F. Ross

[57] ABSTRACT

A sewing machine and method of operating same in which the vertically reciprocatable needle bar is mounted in a guide capable of swinging movement back and forth and the guide, in addition, is shiftable by a separate drive upon withdrawal of the needle from the fabric to form locking or anchoring stitching at the end of a stitched seam.

3 Claims, 3 Drawing Figures

SEWING MACHINE

FIELD OF THE INVENTION

Our present invention relates to a sewing machine and, more particularly, to a sewing machine provided with means for advancing a workpiece in one direction only and capable of immobilizing the workpiece and, more particularly to improvements in anchoring a stitching thread at the end of a stitch seam.

BACKGROUND OF THE INVENTION

Sewing machines generally comprise a worktable across which a fabric workpiece is displaced by a workpiece transport device, e.g. dogs emerging from slots in the table or a workpiece clamp, a head overhanging the table and provided with one or more vertically reciprocatable needles, and the associated drive and thread-feed mechanisms designed to allow the needle upon each thrust through the fabric workpiece, to form a stitch of a stitch seam. The vertically reciprocatable needle is generally held in a needle bar which is likewise given an up and down movement, e.g. by a cam, crank or the like.

It is known to terminate a stitch seam, so as to prevent loosening, ravelling or pulling of the sewn thread, with a thickened accumulation of stitches or a locking stitch arrangement at the end of the stitch seam.

A locking terminus for the stitch seam has an advantage over stitch densification in that it is of greater strength although its formation is more complex and hence more expensive.

Stitch densification can be brought about by slowing the advance of the workpiece or merely immobilizing it to allow a multiplicity of stitches to be formed in a limited region. However, to lock the stitch seam it has hitherto been necessary to bring about a change in the direction of advance of the workpiece. For example, a lock formation at the end of a longitudinal stitch seam requires movement of the fabric back and forth while the needle forms the stitches of the lock.

This not only complicates the feed of the workpiece material but, in the case of sewing machines in which the needle is provided on a support for zig-zag movement, also complicates the needle-drive mechanism. Especially in the latter case difficulties have been encountered with the locking of a stitch seam at the end of its formation.

OBJECTS OF THE INVENTION

It is the principal object of our present invention to provide an improved sewing machine capable of forming lock at the end of a stitch seam in a far less complicated manner than has hitherto been the case.

Another object of the invention is to provide an improved needle-drive system for a sewing machine, especially to simplify the termination of a stitch seam.

It is yet a further object of our invention to provide a sewing machine mechanism which obviates the disadvantages of earlier systems and, in particular, enables a stitching seam to be terminated against loosening without complex fabric or workpiece movements.

SUMMARY OF THE INVENTION

These objects and others which will become apparent hereinafter are attained, in accordance with the present invention, in a sewing machine having a workpiece (fabric) transport device and a vertically reciprocatable needle bar received in a rocker arm capable of back and forth movement, which additionally is provided with drive means for selectively displacing the rocker or guide upon withdrawal of the needle from the workpiece material. The rocker arm can be shiftable apart from the needle transport and the additional drive mechanism can include a fluid responsive cylinder controlled by the position or up and down movement of the needle.

The control according to the invention can be effected via a three-port, two-position (3/2-distributing) valve which can be electromagnetically controlled in response to the movement of the needle and alternately connects the air pressure source and a vent to the cylinder of the fluid response means.

BRIEF DESCRIPTION OF THE DRAWING

The above and other objects, features and advantages of the present invention will become more readily apparent from the following description, reference being made to the accompanying diagrammatic drawing showing only the part of the apparatus essential to the present invention, conventional elements being omitted to the extent that they are not imperative to an understanding of the invention. In the drawing.

SPECIFIC DESCRIPTION

Figure 1:
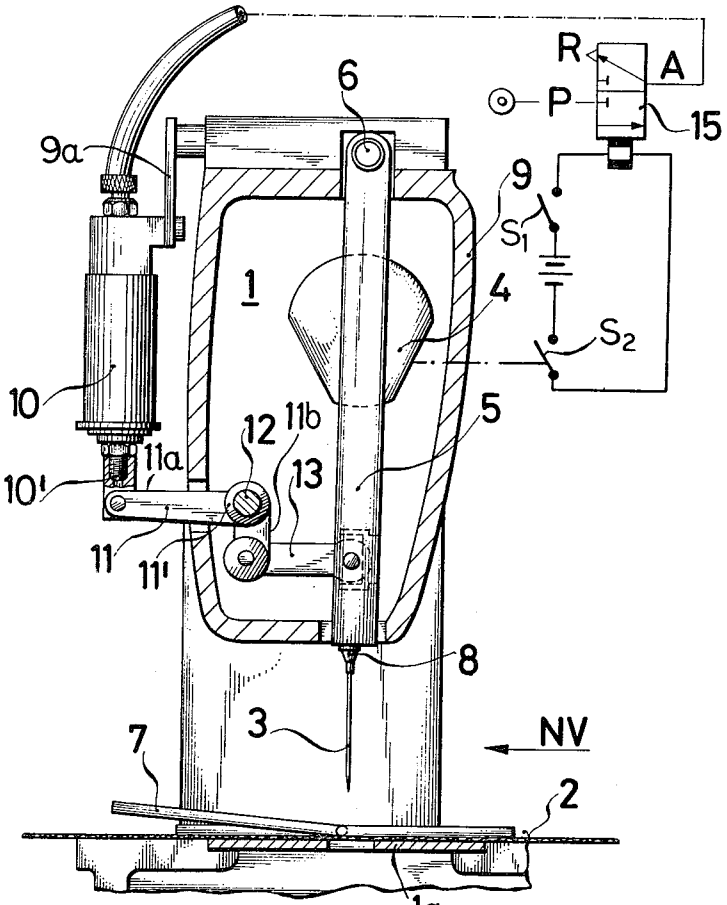
FIG. 1 is a vertical end section through the sewing machine head of a two needle zigzag sewing machine using a fabric clamp as the workpiece-feed or transport mechanism.
Figure 2:
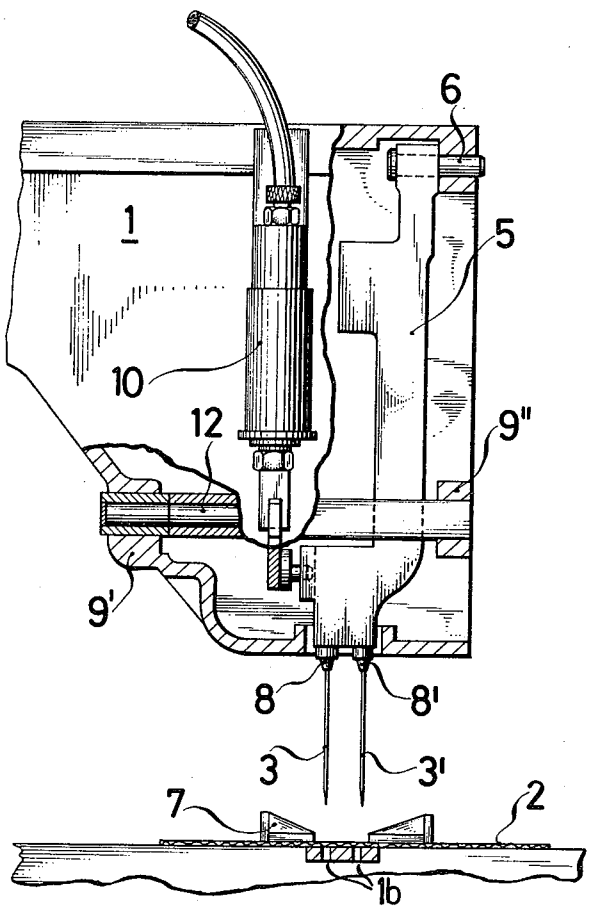
FIG. 2 is a fragmentary section of this head seen from the side.

In FIGS. 1 and 2 we have shown, in the most diagrammatic fashion, the head 1 of a two needle linear-seam sewing machine of conventional construction. The worktable 1*a* is disposed below the head 1 and has a stitching location represented at 1*b* for the two needles 3 and 3'. The underthread and its feed mechanism has not been shown and is conventional in the art.

In the embodiment illustrated, the fabric feed device is a fabric clamp 7 of conventional design and construction which engages the workpiece 2, usually formed by two fabric layers, so that during the formation of a stitch seam, the workpiece is advanced only in the seam-forming feed direction NV although the fabric transport means formed by this clamp can be halted to bring the fabric to standstill.

The vertical reciprocation of the needles 3 and 3' is effected in a conventional manner and only the crank or eccentric mechanism therefor has been represented at 4 in FIG. 1.

The needles 3 and 3' cooperate with conventional loop catchers for the formation of parallel straight-stitch means, lock stitch seams or chain stitch seams in the conventional manner.

For example, when the sewing machine is used to stitch the fabric portions forming trouser pockets, two parallel rows of stitches can be formed and in the region of pocket opening, the bordering material can be fixed at both sides by the stitch seams. At the end of each stitch seam, as will be described in greater detail below, the respective row of stitching is secured by locking.

To generate longitudinal locks at the starting and ending terminuses of the seam, the needle bars 8 and 8' carrying the needles 3 and with which they are vertically reciprocated, are swingable in a needle bar guide which permits the vertical reciprocating movement of the needles.

In the system of the present invention, this guide is a rocker arm 5 which is pivoted on a pin 6 rigid with the machine housing so that the needles 3 and 3' and, in addition to their up and down movement, a swinging movement in the direction of the stitch formation to permit longitudinal locks to terminate the stitch seams.

A swinging movement is imparted to the rocker arm 5 by a single-acting pneumatic cylinder 10 whose piston rod 10' is pivotally connected to a bell-crank lever 11.

The pneumatic cylinder 10 is mounted vertically on the exterior of the housing 9 by a bracket **9*a*** so that it has a vertical orientation.

At the junction between the substantially horizontal relatively long arm **11*a* of the bell-crank lever and the substantially vertical relatively short arm 11*b* thereof, the bell-crank lever is provided with a pivotal eye which is rotatable on a pintal or shaft 12 anchored in thickened portions 9', 9'' of the housing 9** formed during the casting thereof.

Upon advance of the piston rod 10' out of the cylinder 10 (FIG. 1) the bell-crank lever is rotated counterclockwise so that its arm **11*b*** swings to the right.

A link 13 is articulated to this arm and is pivotally connected to the swinging arm 5 to transmit the movement of a bell-crank lever to the guide arm 5.

The restoring spring (not shown) in the single-acting cylinder 10 tends to retract the rod 10' into the cylinder upon depressurization thereof thereby rotating the bell-crank lever 11 in the opposite sense and displacing the rocker arm 5 to the left.

The control of the pneumatic cylinder is effected by conventional means in dependence upon the positions of the needles 3 and 3' to ensure that the swinging movement does not occur while these needles are in engagement with the fabric.

To this end the pneumatic cylinder 10 is supplied by the pneumatic line A from a 3/2 valve 15 whose other ports are connected to a vent R and to the pneumatic pressure network of the plant as represented at P. This network can represent any source of compressed air. The valve is in the venting position as shown diagrammatically in FIG. 1. In this position the pneumatic cylinder is not charged with pneumatic fluid so that its rod 10' is withdrawn and the needles 3 and 3' assume their extreme left hand positions (FIG. 1).

When the electromagnet of the valve 15 is energized, e.g. by closure of switch $S_1$, and the withdrawal of the needles from the fabric which also closes series switch $S_2$, the cylinder is connected to the pressure source P and is energized to swing the arm 5 into its extreme right hand position.

Figure 3:
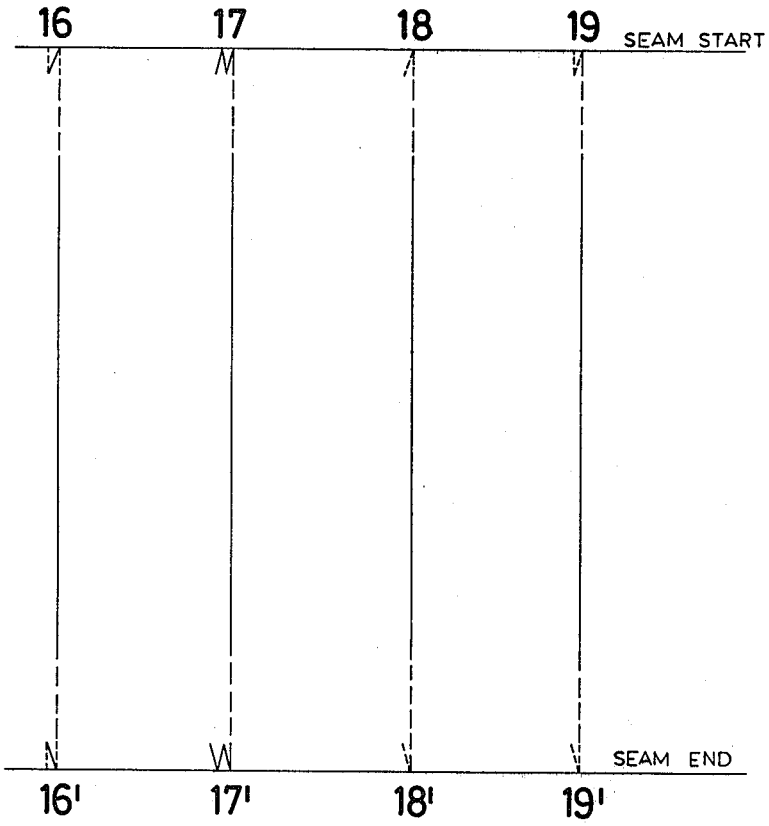
FIG. 3 is a diagram illustrating various locking modes which can be effected with the machine illustrated in FIGS. 1 and 2.

With the system described, various locking patterns can be obtained at each or either end of the stitch seam. These patterns have been shown diagrammatically in FIG. 3 one of the needles and the straight stitch seam normally formed thereby.

The locks 16 and 16' are each formed from three small forward stitches of the workpiece clamp and a full rearward swinging movement of the guide 5. The locks 17, 17'; 18, 18' and 19, 19' are each formed with the workpiece at standstill only by swinging the guide 5 during vertical reciprocation of the needle.

Naturally the system of the present invention can produce transverse locks by a corresponding swing of the guide in the transverse direction using similar means and a needle transport can be provided with advantage in the system as well. The switch $S_1$ can be switched on and off by any appropriate programming device common in the automated sewing machine art and the system can operate with a presser foot and dog-type workpiece feed as well.

We claim:

1. In a sewing machine having a worktable, means for advancing a workpiece to receive a stitch seam along said table past a stitch location, a head overhanging said location and formed with a housing, a needle bar vertically reciprocatable in said housing and carrying at least one needle, and drive means including an eccentric rotatable in said housing for vertically reciprocating said needle bar to sew said seam in said workpiece, the improvement which comprises a mechanism for forming a stitching lock against loosening for said seam at least at one end thereof, said mechanism comprising:

a guide for said bar in said housing in the form of a rocker suspended from a pivot in said housing and swingable transversely to the direction of reciprocation of said bar;

a pneumatic cylinder mounted on said head and having a piston rod;

a bell-crank lever having one side articulated to said piston rod of said cylinder and another side articulated to a link pivotally connected to said rocker for shifting same in said housing;

control means for operating said pneumatic cylinder only upon withdrawal of said needle from said workpiece, said control means including a three-port, two-position valve having one port connected to said cylinder, another port connected to a vent and a third port connected to a pressurized air source, said valve being electromagnetically operated; and circuit means responsive to the position of said eccentric for operating said valve.

2. The improvement defined in claim 1 wherein the means for displacing the workpiece along said table is a fabric clamp.

3. The improvement defined in claim 1 wherein said rocker is swingable in a plane parallel to the direction of movement of the workpiece along said table.

* * * * *